US007770551B2

(12) United States Patent
Gallatz et al.

(10) Patent No.: US 7,770,551 B2
(45) Date of Patent: Aug. 10, 2010

(54) METHOD FOR IGNITING COMBUSTION OF FUEL IN A COMBUSTION CHAMBER OF AN ENGINE, ASSOCIATED DEVICE AND ENGINE

(75) Inventors: Volker Gallatz, Herrenberg (DE); Nikita Hirsch, Stuttgart (DE); Irina Tarasova, Ekaterinburg (RU)

(73) Assignee: MWI Micro Wave Ignition GmbH, Empfingen (DE)

( * ) Notice: Subject to any disclaimer, the term of this patent is extended or adjusted under 35 U.S.C. 154(b) by 0 days.

(21) Appl. No.: 10/580,196

(22) PCT Filed: Nov. 26, 2004

(86) PCT No.: PCT/EP2004/013421

§ 371 (c)(1),
(2), (4) Date: Jan. 24, 2007

(87) PCT Pub. No.: WO2005/059356

PCT Pub. Date: Jun. 30, 2005

(65) Prior Publication Data

US 2007/0240660 A1 Oct. 18, 2007

(30) Foreign Application Priority Data

Dec. 1, 2003 (DE) ..... 103 56 916

(51) Int. Cl.
*F02B 19/00* (2006.01)
*F02P 23/00* (2006.01)

(52) U.S. Cl. ..... 123/143 B; 123/143 R; 431/2; 431/6; 338/214

(58) Field of Classification Search ..... 123/143 B, 123/536, 143 R, 660, 657, 149 F; 338/214, 338/20; 431/2, 6; *F02B 19/00; F02P 23/00*
See application file for complete search history.

(56) References Cited

U.S. PATENT DOCUMENTS

| | | | | |
|---|---|---|---|---|
| 2,563,952 | A * | 8/1951 | Nichol | 123/633 |
| 2,617,841 | A | 11/1952 | Linder | |
| 3,934,566 | A * | 1/1976 | Ward | 123/275 |
| 4,138,980 | A * | 2/1979 | Ward | 123/536 |
| 4,297,983 | A * | 11/1981 | Ward | 123/536 |
| 4,314,530 | A | 2/1982 | Giacchetti | |
| 4,446,826 | A | 5/1984 | Kimura et al. | |

(Continued)

FOREIGN PATENT DOCUMENTS

| | | |
|---|---|---|
| DE | 196 44 514 | 4/1998 |

(Continued)

*Primary Examiner*—Devon C Kramer
*Assistant Examiner*—Keith Coleman
(74) *Attorney, Agent, or Firm*—Roylance, Abrams, Berdo & Goodman, L.L.P.

(57) ABSTRACT

A method ignites the combustion of fuel in a combustion chamber (5) of engine (2), by introducing microwave radiation into the combustion chamber (5). The microwave radiation is produced in a microwave source (7) on the outside of the combustion chamber (5). The introduced microwave radiation is absorbed by the fuel distributed in the combustion chamber (5). The supply of energy, in the fuel, arising from absorption, distributes combustion in a large-volume in the combustion chamber (5), preferably in the entire combustion chamber (5) and in a homogenous manner, and is essentially simultaneously ignited. An associated ignition device (1) and an associated engine (2) are also provided.

11 Claims, 3 Drawing Sheets

U.S. PATENT DOCUMENTS 7,201,882 B2 * 4/2007 Cesa ..... 422/186.04

FOREIGN PATENT DOCUMENTS

| | | |
|---|---|---|
| DE | 197 47 701 | 5/1999 |
| DE | 198 02 745 | 7/1999 |
| DE | 199 14 941 | 5/2000 |
| DE | 100 61 673 | 6/2002 |
| DE | 697 13 958 | 2/2003 |
| EP | 0 680 243 | 11/1995 |
| JP | 55 007972 | 1/1980 |
| JP | 59 215967 | 12/1984 |
| WO | WO 03/042533 | 5/2003 |

* cited by examiner

METHOD FOR IGNITING COMBUSTION OF FUEL IN A COMBUSTION CHAMBER OF AN ENGINE, ASSOCIATED DEVICE AND ENGINE

FIELD OF THE INVENTION

The present invention relates to a process for igniting the combustion of fuel in the combustion chamber or combustion space of an engine, to an associated ignition device and to an associated engine.

BACKGROUND OF THE INVENTION

Because the ignition process has a considerable effect on the efficiency of an internal combustion engine, and especially at a given engine output also largely determines the fuel consumption and pollutant emission, in the past extensive efforts have been made to optimize the ignition process. The currently most common ignition devices use spark plugs which ignite the fuel-air mixture. These spark plugs can have one or more electrodes. Each of these electrodes produces an ignition spark which ignites the fuel-air mixture in the immediate vicinity of the electrode. Combustion begins accordingly first in a very small starting volume around the electrodes of the spark plugs. Subsequently combustion propagates with an admittedly limited velocity.

DE 195 27 873 A1 and U.S. Pat. No. 5,136,944 describe a glow plug having a catalytic surface coating of the glow part for reducing the power consumption required for ignition. The disadvantages involve the production costs due to the required catalyst materials being increased, and the combustion process only insignificantly being optimized. U.S. Pat. No. 4,774,914 and U.S. Pat. No. 6,595,194 describe an ignition device which is designed to generate an especially large ignition spark.

U.S. Pat. No. 4,113,315 describes a two-chamber ignition process in which the fuel-air mixture is ignited by an ignition source in a first, small ignition space. Then, the fuel-air mixture is ignited by the flame propagation occurring in a larger second space, the actual cylinder. U.S. Pat. No. 4,499,872 shows a development of this two-chamber ignition process in which a mixture of ionized water and fuel is ignited using magnetic fields and ignition rods. It is common to the two-chamber ignition processes that they require high construction, and thus, production cost.

U.S. Pat. Nos. 5,673,554 and 5,689,949 disclose ignition processes in which microwave energy is used to produce in the combustion space a plasma which ignites the fuel-air mixture. The formation of the plasma is dependent largely on adherence to narrow boundary conditions with respect to formation of a resonant mode. This arrangement leads to considerable construction effort, especially with respect to the engine pistons which move up and down. Moreover, the microwave transmitter limits the path of piston motion in the engine. The corresponding features also apply to U.S. Pat. No. 5,845,480.

U.S. Pat. No. 5,983,871 describes a combination of injection of microwave and laser energy for producing the plasma. In this way, the complexity of the ignition device and of the ignition process as well as the pertinent engine is further increased. The corresponding also applies to U.S. Pat. No. 6,581,581 which describes a combination of ignition by microwave plasma and magnetic ionization of the atomized fuel-air mixture.

The known processes commonly require complex, and thus, expensive and high-maintenance structures. Moreover, they have only a limited service life. The efficiency of the combustion process, and therefore, of the engine driven by it are limited. In addition, the emission of pollutants is not adequately reduced. In particular, a lower combustion temperature is achieved by the leaning of the fuel-air mixture which has taken place for purposes of reduction of the fuel consumption. This leaning entails less power. The lower combustion temperature also leads to increased pollutant emission.

SUMMARY OF THE INVENTION

An object of the present invention is to provide a process for ignition of the combustion of fuel in the combustion space of an engine, the pertinent ignition device and the pertinent engine which overcome the disadvantages of the prior art. In particular, ignition will take place according the present invention such that the combustion characteristic is optimized, especially with reduced fuel consumption and reduced pollutant emission at a given power.

The object is basically achieved by a process of or a system for ignition of combustion of fuel in the combustion space of an engine by injecting into the combustion space microwave radiation produced in a microwave source outside of the combustion space. The injected microwave radiation is absorbed by the fuel distributed in the combustion space. Due to the energy delivery into the fuel which occurs due to absorption, the combustion is uniformly distributed preferably over a large volume in the combustion space and is ignited essentially at the same time, preferably being uniformly distributed in the entire combustion space and being ignited essentially at the same time.

Generally, the combustion space receives a mixture of fuel and an oxygen source, for example, a fuel-air mixture. By moving the piston in the cylinder, the fuel-air mixture is often compressed during the ignition process. The injection of microwave radiation takes place preferably such that an energy density distribution as homogeneous as possible is formed in the combustion space. For this purpose, either the microwave window can have a comparatively large area or a small-area microwave window can be used. In the latter case, it can be advantageous to provide a diffusion means at the entry point of the microwave radiation into the generally cylindrical combustion space. For example, a suitable flat, point, line or grid structure causes radiation of microwaves into the combustion space with an isotropic directional characteristic. Optionally, a definable energy density distribution in the combustion space can be achieved by the configuration of the diffuser.

The wavelength of the microwaves is preferably between 0.1 cm and 45 cm, especially between 1 cm and 15 cm and typically between 3 cm and 10 cm. In one preferred embodiment of the present invention, the microwaves are injected in pulse form. For this purpose, one or more microwave pulses can be used. The power of the microwave pulses depends on the respective application and can be, for example, between one kilowatt and 70 kW. The pulse length can be, for example, between 1 nsec and 2 msec. The pulse distance for several microwave pulses typically is between 100 nsec and 2 msec.

The supplied microwave energy is used directly for simultaneous and uniform ignition of the entire fuel air mixture. The change of the volume of the combustion space during the pulse interval can be negligibly small due to the pulse duration which is relatively short with respect to the speed of piston motion. The power of the microwave pulses must be selected to be high enough for enough ignition energy to be injected into the combustion space.

The supplied microwave energy heats the fuel droplets present in the fuel-air mixture up to the ignition point, and thus, ignites the mixture. In contrast to the prior art, in the present invention the production of a plasma is avoided.

In contrast to the known ignition systems, in the present invention ignition takes place not at a single given site in the combustion space, and therefore, need not then propagate comparatively slowly. Preferably, the entire fuel-air mixture is ignited almost simultaneously and uniformly in the entire combustion space.

In the known ignition process, the combustion process of the fuel-air mixture in the internal combustion engine proceeds in two phases. In the first phase, comparatively slow, so-called laminar phase, the laminar flame velocity essentially limits the speed of the engine combustion process, and thus, the efficiency. Typical laminar flame velocities especially of modern internal combustion engines with leaned mixture compositions are roughly 10 cm/sec. The laminar phase is followed by a turbulent combustion phase. From the standpoint of efficiency as high as possible, the second turbulent combustion phase should always be reached as quickly as possible. This is also the focus of some efforts from the prior art, in which as before the first phase must proceed to reach the second phase.

In contrast, according to the present invention the first, slow laminar combustion phase is completely skipped. Ignition leads directly to the second, high-speed turbulent combustion phase.

The present invention also relates to an ignition device for executing this process. The electrical power supply source is preferably a pulsed high voltage power pack which makes available the energy required for the microwave pulses. The microwave source can be, for example, a magnetron, klystron, gyrotron, travelling wave tube, (TWT) or the like. Possible microwave connections must be adapted to the wavelength of the microwave source with respect to their dimensions to keep reflections and power losses as small as possible. If necessary, the microwave line can also be made flexible.

In one preferred embodiment of the present invention, a coupling means is between the microwave source and the microwave window. The coupling means transmits the microwaves sent by the microwave source to the microwave window, but does not transmit the microwaves reflected by the combustion space back into the microwave source. In particular, this coupling means can have a triple port, especially a circulator with a microwave source connected to its first port, a microwave window connected to its second port and a preferably passive microwave consumer connected to its third port. The circulator relays microwave energy from the microwave source to the combustion space, and at the same time diverts the microwave energy radiated back by the combustion space to the passive microwave consumer which absorbs the microwave energy reflected by the combustion space. In this way, the microwave source is protected against reflected microwave radiation. The circulator can contain a gas-filled discharger to improve the function of reducing the microwave energy which has been radiated back.

The microwave window is essentially transparent to microwave energy, in particular high microwave power can also be transported through it. It also seals the combustion space to the outside. One possible embodiment of the microwave window in a ceramic disk, a sapphire glass disk or a disk of another suitable material. The microwave window can moreover, for example, have two-dimensional or even three-dimensional structures, preferably on the surface. For example, by application of a metallic structure a definable emission characteristic of microwave energy into the combustion space is ensured.

The present invention also relates to an engine with an ignition device which operates according to the ignition process of the present invention. One special version is an Otto engine, Wankel engine, SIDI (spark ignition direct injection) engine or diesel engine in which a fuel-air mixture in the combustion space is ignited.

This present invention leads to optimum combustion of the fuel-air mixture in an engine in that in the entire combustion space, by the simultaneous and uniform ignition and combustion of the fuel-air mixture, a first, slow laminar combustion phase is not formed. Instead, the second, high-speed turbulent combustion phase is started directly upon combustion. For this purpose, throughout the combustion, space small, turbulent ignition and combustion zones which propagate independently of one another are produced almost simultaneously in a very large number. Accordingly the fuel-air mixture in the entire combustion space is ignited almost at the same time and then burned.

By using several microwave pulses, the fuel droplets present in the fuel-air mixture are heated gradually until the ignition temperature is reached. In this way, basically unwanted different temperature regions in the combustion space are avoided since the gradual increase of the temperature leads to a more uniform, and thus, ultimately practically simultaneous and uniform ignition of the entire mixture in the combustion space. Moreover, basically likewise unwanted plasma generation is prevented by the repeated pulses.

Other objects, advantages and salient features of the present invention will become apparent from the following detailed description, which, taken in conjunction with the annexed drawings, discloses one preferred embodiment of the present invention.

BRIEF DESCRIPTION OF THE DRAWINGS

Referring to the drawings which form a part of this disclosure.

DETAILED DESCRIPTION OF THE INVENTION

Figure 1:
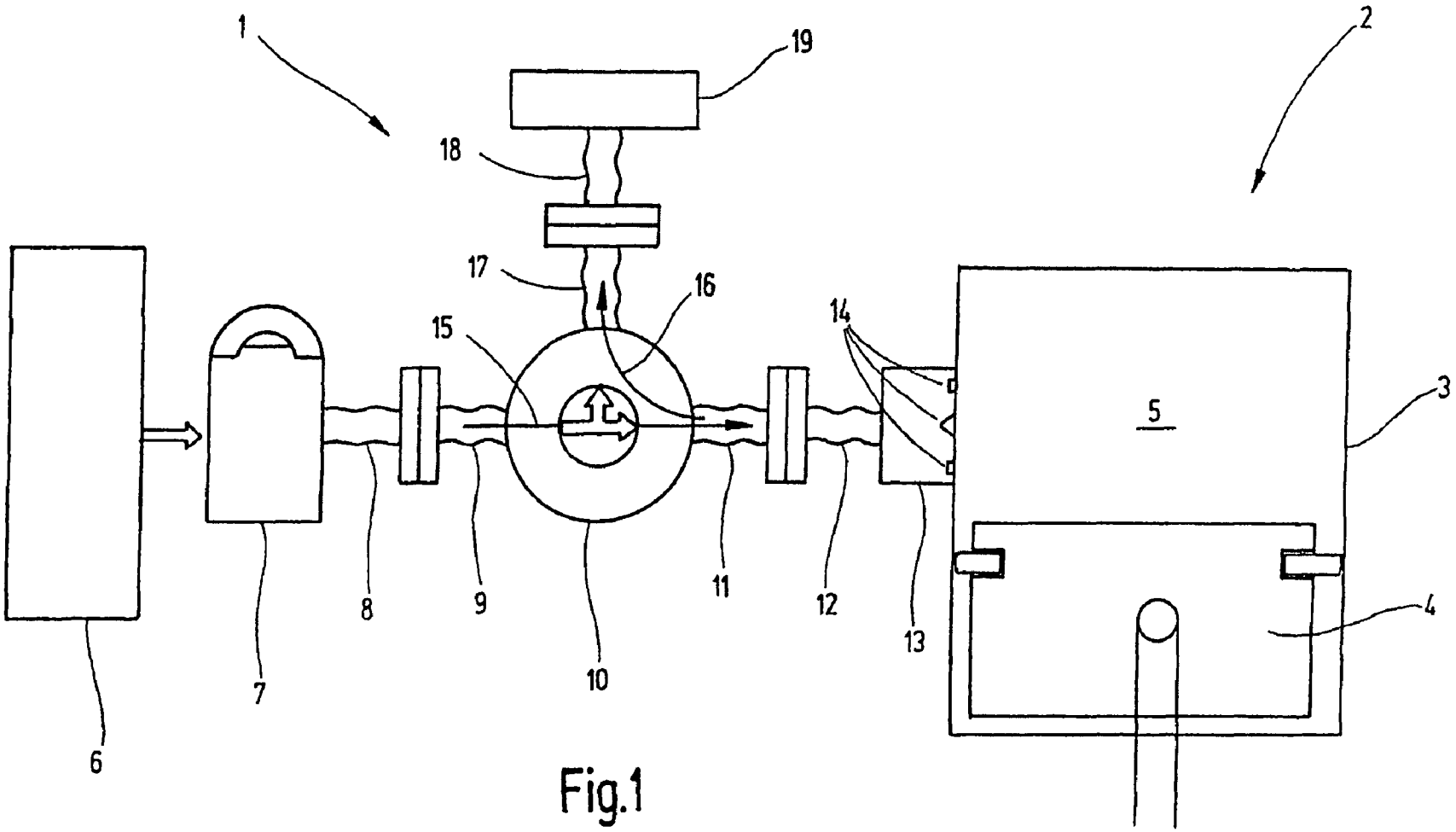
FIG. 1 is a schematic diagram of an ignition device according to an exemplary embodiment of the present invention.

FIG. 1 schematically shows the structure of an ignition device 1 according to an exemplary embodiment of the present invention for a schematically shown engine 2. Only the cylinder 3 and the piston 4 which moves up and down in it are shown. The piston 4 and the cylinder 3 border the combustion space 5 in which ideally a fuel-air mixture is uniformly distributed. In FIG. 1 the piston 4 is roughly at top dead center.

The ignition device 1 comprises a pulsed high voltage power pack 6 with energy which drives the microwave source 7. A first piece of preferably flexible microwave line 8 is connected by a flange to a first connecting flange 9 of the circulator or coupler 10. On the side opposite the first connecting flange 9, the circulator 10 has a second connecting flange 11 connected by a flange to a second, preferably flexible microwave line 12 leading to the microwave window 13.

The microwave window 13 is fixed on the jacket surface of the cylinder 3 such that the microwaves are radiated into the combustion space 5. The energy density distribution in the combustion space 5 is as uniform as possible. In one preferred embodiment, the microwave window 13 comprises a ceramic disk inserted in the cylinder 3 such that the combustion space 5 is sealed to the outside. The microwave window 13 can have on its side facing the combustion space 5 structures 14 providing a diffuse incident radiation characteristic of the microwaves emitted into the combustion space 5.

The microwave energy supplied by the first connecting flange 9 is supplied via the second connecting flange 11 to the microwave window 13 by the circulator 10 according to the energy flow represented by the arrow 15. That flow is essentially undamped, and is injected into the combustion space 5. Reflections occurring in the combustion space 5 can lead to re-radiation of microwave energy via the second microwave line 12 and into the second connecting flange 11. The circulator 10 ensures diversion of the microwave energy according to arrow 16, specifically not back into the first connecting flange 9, but via a third connecting flange 17 connected to a third microwave line 18 to guide the reflected energy flow to a passive microwave consumer 19. The connecting flanges 9, 11, 17 of the circulator 10 can also be arranged symmetrically at angular distances of 120° in contrast to the orientation shown in FIG. 1.

The ignition process of the present invention was tested with an ignition device of the present invention on an internal combustion engine. It was a four-stroke Otto engine with four cylinders and a volume of 1300 $cm^3$. The engine output was 63 hp/46.6 kW. In operation with a conventional ignition system, the fuel consumption was roughly 6.5 liters per 100 km.

In this series production engine, the spark plugs were removed, and ceramic disks were used in their place as seals and as a microwave window. The structure of the ignition device 1 corresponded to that of FIG. 1. The internal combustion engine was mechanically connected to an electric generator, so that it was possible to determine the engine output. An ohmic consumer located in a water calorimeter was connected to the generator.

Figure 2:
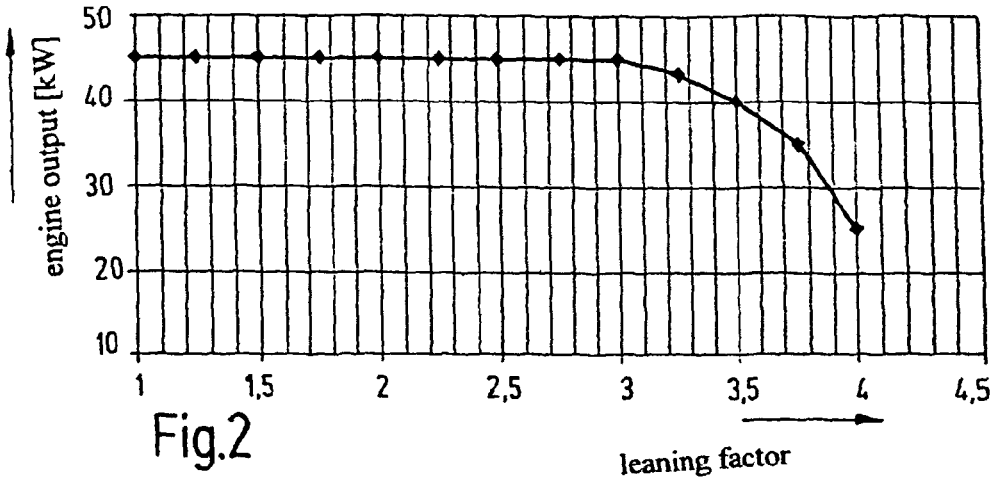
FIGS. 2 to 4 are graphs of the output of the engine as a function of the reduction in the amount of fuel in the fuel-air mixture (leaning)
Figure 3:
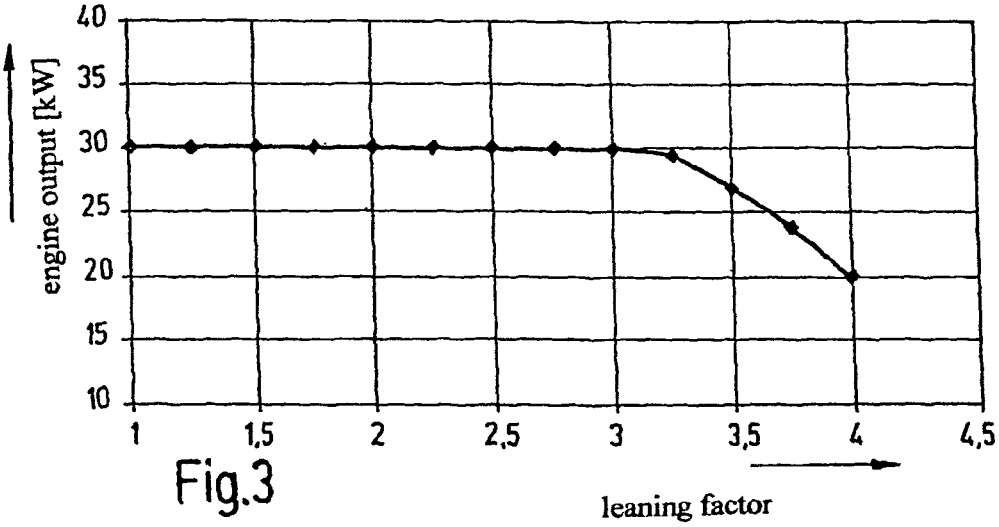
Figure 4:
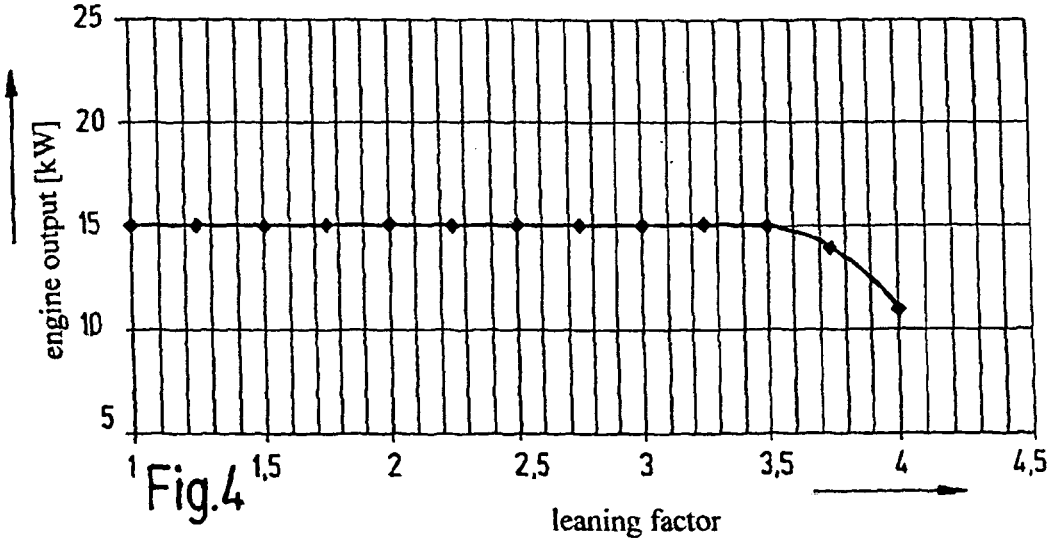

FIGS. 2 to 4 show the output of the engine as a function of the reduction of the amount of fuel in the fuel-air mixture (leaning) in three different operating ranges, specifically at full load (FIG. 2), half load (FIG. 3) and one-third load (FIG. 4). The leaning factor is defined as the fraction to which the fuel portion has been reduced, in FIGS. 2 to 4 proceeding from 1/1 to 1/4.5-th. These graphs show that, in operation with the ignition device of the present invention, the fuel portion in the mixture itself under full load can be leaned by a factor of 3 without the power being reduced. At one-third load, this factor is even 3.5.

Figure 5:
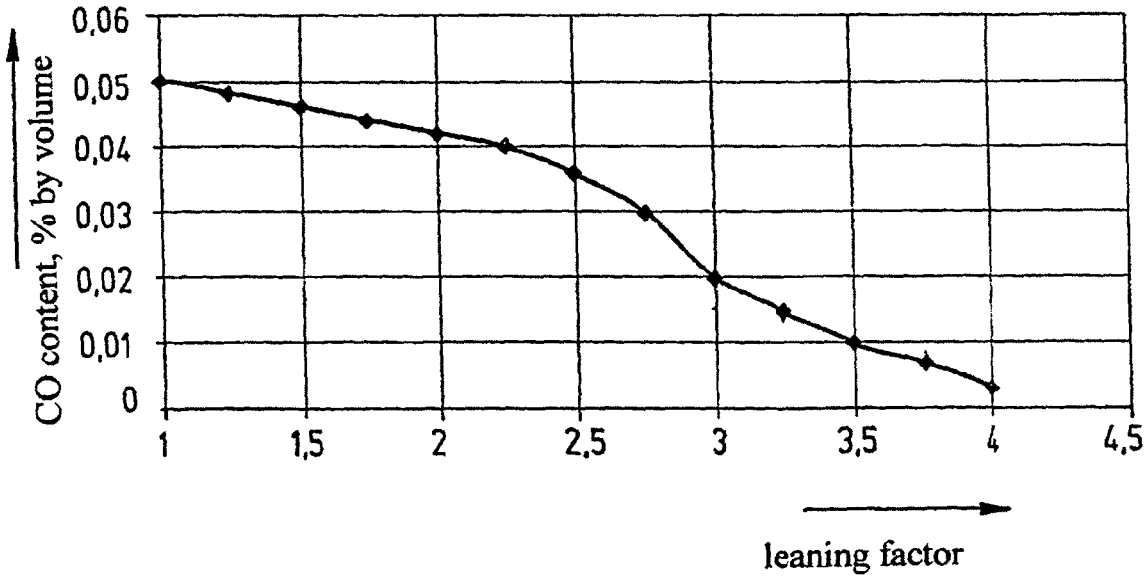
FIG. 5 is a graph of the CO content of the engine as a function of the leaning.

FIG. 5 shows the reduction of carbon monoxide (CO) content in the exhaust gases of the engine as of the present invention as a function of the fuel concentration in the fuel-air mixture. Even at a factor of 1, the concentration of CO with 0.05% by volume is clearly less than in a standard engine with a conventional ignition device, where this value is roughly 0.20% by volume. For leaning by a factor of 3, the CO content can be reduced even more, down to 0.02% by volume. This means a reduction of the CO release by a factor of 10. For approximately the same output, the consumption with the ignition process of the present invention was only 2.3 liters of gasoline per 100 km, therefore roughly one third of the consumption with a conventional ignition process.

While one embodiment has been chosen to illustrate the invention, it will be understood by those skilled in the art that various changes and modifications can be made therein without departing from the scope of the invention as defined in the appended claims.

What is claimed is:

1. A process for ignition of combustion of fuel in a combustion space of an engine, comprising the steps of:

conveying fuel into the combustion space;

producing microwave energy in a microwave source located outside the combustion space;

injecting the microwave radiation into and uniformly throughout the combustion space with fuel therein in at least one microwave pulse of short duration and of high energy;

preventing formation of plasma by selection of a time interval for injecting of the microwave radiation, of power of the microwave radiation, of pulse duration and of pulse spacing;

absorbing the microwave pulse by the fuel distributed into the combustion space; and igniting the fuel uniformly over a large space in the combustion space by energy delivered into the fuel due to absorption of the microwave pulse essentially at the same time.

2. A process according to claim 1 wherein at least one of a number of spaced microwave pulses, power of the microwave pulses, pulse duration and pulse timing is controlled depending on engine operating states and power demands on the engine.

3. A process according to claim 1 wherein the microwave radiation is injected in 1 to 10 spaced microwave pulses.

4. A process according to claim 3 wherein the microwave radiation is injected in 1 to 5 spaced microwave pulses.

5. A process according to claim 1 wherein said microwave pulse has a power between 1 kW and 70 kW.

6. A process according to claim 1 wherein the microwave pulse has a duration between 1 ns and 2 ms.

7. A process according to claim 3 wherein the microwave pulses are spaced between 100 ns and 2 ms.

8. A process according to claim 1 wherein the microwave radiation is injected in 1 to 10 spaced microwave pulses;

each microwave pulse has a power between 1 kW and 70 kW; and each microwave pulse has a duration between 1 ns and 2 ms.

9. A process according to claim 8 wherein the microwave radiation is injected in 1 to 5 spaced microwave pulses.

10. A process according to claim 1 wherein the microwave radiation is injected in several spaced microwave pulses of at least one of different power and different pulse duration for leveling temperature increases of the fuel in the combustion space up to an ignition temperature by gradual delivery of energy.

11. A process according to claim 1 wherein the microwave radiation is injected into the combustion space in spaced microwave pulses.

* * * * *